US007482897B2

(12) United States Patent
Puoskari et al.

(10) Patent No.: US 7,482,897 B2
(45) Date of Patent: Jan. 27, 2009

(54) BAND STOP FILTER

(75) Inventors: Jukka Puoskari, Tupos (FI); Jouni Ala-Kojola, Kempele (FI)

(73) Assignee: Filtronic Comtek Oy, Kempele (FI)

( * ) Notice: Subject to any disclaimer, the term of this patent is extended or adjusted under 35 U.S.C. 154(b) by 204 days.

(21) Appl. No.: 10/599,809

(22) PCT Filed: Apr. 29, 2005

(86) PCT No.: PCT/FI2005/050140

§ 371 (c)(1),
(2), (4) Date: Oct. 10, 2006

(87) PCT Pub. No.: WO2005/109565

PCT Pub. Date: Nov. 17, 2005

(65) Prior Publication Data

US 2007/0273459 A1 Nov. 29, 2007

(30) Foreign Application Priority Data

May 12, 2004 (FI) ..... 20040672

(51) Int. Cl.
*H01P 1/205* (2006.01)

(52) U.S. Cl. ..... 333/206; 333/222

(58) Field of Classification Search ..... 333/203, 333/206, 207, 202, 212, 222, 223
See application file for complete search history.

(56) References Cited

U.S. PATENT DOCUMENTS

| | | | | |
|---|---|---|---|---|
| 4,437,076 | A | 3/1984 | Makimoto et al. | |
| 5,191,304 | A | 3/1993 | Jachowski | |
| 5,949,309 | A * | 9/1999 | Correa | 333/202 |
| 5,977,848 | A | 11/1999 | Nakaguchi et al. | |
| 2003/0001697 | A1 | 1/2003 | Bennett et al. | |

FOREIGN PATENT DOCUMENTS

| | | | |
|---|---|---|---|
| EP | 0 859 422 | A1 | 8/1998 |
| FI | 106584 | B | 8/1998 |

* cited by examiner

*Primary Examiner*—Stephen E Jones
(74) *Attorney, Agent, or Firm*—Darby & Darby P.C.

(57) ABSTRACT

A band stop filter comprises a transmission line with center and outer conductors, and coaxial resonators. The outer conductor forming a unitary conductive housing with an inner space divided by conductive partition walls into resonator cavities. Each of the resonator cavities contains at least one of the coaxial resonators, wherein each of the coaxial resonators separately has an electromagnetic coupling to the transmission line. The coupling arranged by a coupling element to form an attenuation peak in the a response curve of the filter, where the natural frequencies of the coaxial resonators differ from each other to shape the response curve of the filter. The transmission conductor is located inside the housing, running through openings in the partition walls across all the resonator cavities. The housing is the outer conductor of the transmission line, and a portion of the transmission conductor in a resonator cavity is the coupling element.

9 Claims, 4 Drawing Sheets

BAND STOP FILTER

CLAIM OF PRIORITY

This patent application claims the benefit of priority, under 35 U.S.C. § 365, of International Application No. PCT/FI2005/050140, filed Apr. 29, 2005, titled "Band Stop Filter," which published in the English language on Nov. 17, 2005, and also claims the benefit of priority, under 35 U.S.C. § 119, of Finland Application No. 20040672 filed May 12, 2004. The entire disclosures of each are hereby incorporated herein by reference in their entirety.

FIELD OF THE INVENTION

The invention relates to a band stop filter implemented by coaxial resonators for filtering antenna signals particularly in base stations of mobile communication networks.

BACKGROUND OF THE INVENTION

In bidirectional radio systems of mobile communication networks, the transmitting and receiving bands are relatively close to each other. In the full duplex system, in which signals are transferred in both directions simultaneously, it must be especially ensured that a transmitting of relatively high power does not interfere in the receiving or wide-band noise of the transmitting block the receiver. The output signal of the transmitter power amplifier is therefore strongly attenuated on the receiving band of the system before feeding to the antenna. When the transmitting band is above the receiving band, a high-pass filter is sufficient for that in principle. However, if signals of some other system, the spectrum of which is below the above mentioned receiving band, are also fed to the antenna through the same antenna filter, a band stop filter is needed for the attenuation.

FIG. 1 shows an example of a known band stop filter used as an antenna filter. The filter 100 comprises, in a unitary conductive filter housing a first R1, a second R2 and a third R3 coaxial resonator, which have no mutual coupling. The filter housing has been drawn in FIG. 1 with its cover removed and cut open so that the inner conductors of the resonators, such as the inner conductor 101, are partly visible. The inner space of the housing is divided by conductive partition walls into resonator cavities. The lower ends of the inner conductors of the resonators join galvanically to the bottom of the housing and thus to the signal ground GND. Their upper ends have only a capacitive coupling to the cover of the housing and the surrounding, conductive walls, and so the resonators are quarter-wave resonators. In addition, the filter 100 comprises a coaxial transmission line 120 and an arrangement for coupling the transmitting line to the resonators. The transmission line runs through three coaxial T-connectors, which are galvanically fastened to one side wall 112 of the resonator housing. The first T-connector 131 is at the first resonator R1, the second T-connector 132 at the second resonator R2 and the third T-connector 133 at the third resonator R3. In the example of FIG. 1, the electric distance between two successive connectors is a quarter of the wavelength on the middle frequency of the filter stop band, which is an advantageous length with regard to the matching of the transmitting path. The conductive casing of the branch part of each T-connector is in galvanic contact with the side wall 112, and so the outer conductor of the transmission line becomes connected to the ground GND. The inner conductor of the branch part of the first T-connector has been connected to the first coupling element 141 in the cavity of the first resonator. That element is a rigid conductor, which in this example extends relatively close to the upper end of the inner conductor 101 of the first resonator. In this way, the first resonator becomes electromagnetically coupled parallel with the transmission line 120. In the same way, the second resonator becomes coupled parallel with the transmission line by means of the coupling element 142 in the cavity of the second resonator, and the third resonator by means of the coupling element 143 in the cavity of the third resonator. The shape of the coupling element can vary, and it can be, for example, a loop conductor going round the lower end of the inner conductor of the resonator.

The ends of the transmission line 120 function as the input and output ports of the band stop filter 100. The end of the transmission line on the side of the first resonator is, for example, the input port IN and the second end is the output port OUT. The band stop property is based on that the resonator represents at its natural frequency a short circuit as viewed from the transmission line. In that case the energy fed to the transmission line is almost entirely reflected back to the feeding source, and hardly any energy is transferred to the load coupled to the output port. At frequencies that are clearly lower or higher than the natural frequency, the resonator is seen as a high impedance, in which case the energy of the signal is transferred to said load without any obstacle. One resonator provides a relatively narrow stop band. By using more than one resonator and by adjusting their natural frequencies to have different values but suitably close to each other, the stop band can be widened.

FIG. 2 shows two examples of the amplitude response of a three-resonator band stop filter. The response curves 21 and 22 show the change of the transmitting coefficient $S_{21}$ of the filter as a function of frequency. The smaller the transmitting coefficient, the higher the attenuation of the filter is. In both cases, the natural frequencies of the resonators have been arranged at the points 1925 MHz, 1950 MHz and 1975 MHz, for which reason an attenuation peak occurs at these frequencies. Between two adjacent attenuation peaks, the attenuation gets a minimum value, which is the minimum attenuation in the stop band, or more briefly, the stop attenuation. The attenuation values depend on the strengths of the electromagnetic couplings arranged by the coupling elements in the resonators. In the case of the first curve 21, the stop attenuation is arranged to the value 20 dB by the coupling elements, and to the value 40 dB in the case of the second curve 22. It can be seen from the shape of the curves that increasing the attenuation widens the transition bands of the filter. A transition band means an range between the stop band and the pass band, when the pass band is considered to be an range on which the attenuation is, for example, 1 dB at the highest. In duplex systems, the range between the transmitting and receiving bands, or the duplex spacing, has been specified to have a certain value. The transition band of the filter must naturally be narrower than the specified duplex spacing, which means that the stop attenuation cannot be freely increased. This also applies to filters according to the invention.

One drawback of the filter according to FIG. 1 is a relatively large number of structural parts in the transmission line structure, which increases the production costs. A large number of parts also means numerous conductive junctions, which causes harmful intermodulation. Where a transmission end filter is concerned, the problem is emphasized because of the relatively high currents that occur in it. A further drawback is the difficult tuning of the filter. The tuning includes both setting the natural frequencies of the resonators and setting the strengths of the couplings between the resonators and the transmission line. In accordance with the above-described, the tuning takes place by bending straight coupling elements or by shaping loop-like coupling conductors in relation to the inner conductors of the resonators. The resonators are not entirely isolated in practice, but the tuning of one influences the natural frequencies of the others through the transmission line of the filter. This results in a number of manual iteration rounds in the tuning, which means a significant cost factor in production.

SUMMARY OF THE INVENTION

In one aspect of the invention, a band stop filter, which comprises a transmission line with a center conductor and an outer conductor and a plurality of coaxial resonators; the outer conductor forming a unitary conductive housing having an inner space which is divided by conductive partition walls into resonator cavities; each of said resonator cavities containing at least one of the plurality of coaxial resonators, wherein each of the coaxial resonators separately has an electromagnetic coupling to the transmission line; said coupling arranged by a coupling element to form an attenuation peak in the a response curve of the filter, the natural frequencies of the coaxial resonators differing from each other to shape the response curve of the filter; wherein the transmission conductor is located inside said housing, running through openings in said partition walls across all the resonator cavities; and wherein the housing is the outer conductor of the transmission line, and a portion of the transmission conductor in a resonator cavity is said coupling element.

BRIEF DESCRIPTION OF THE DRAWINGS

In the following, the invention will be described in more detail. Reference will be made to the accompanying drawings, in which.

DETAILED DESCRIPTION OF THE INVENTION

By way of overview and introduction, a band stop filter structure comprises a transmission line and coaxial resonators electromagnetically coupled parallel with it, the natural frequencies of the resonators differing from each other slightly. The resonators form a unitary conductive resonator housing, the inner space of which has been divided into resonator cavities by conductive partition walls. The center conductor of the transmission line is placed inside the resonator housing so that it runs through all the resonator cavities, and the housing functions as the outer conductor of the transmission line at the same time. The resonator cavities are thus a part of the cavity of the transmission line. When an electromagnetic field of the same frequency as the natural frequency of a resonator occurs in the transmission line, the resonator in question starts to oscillate, causing the field to reflect back towards the feeding source. The strength of the resonance and the width of its range of influence at the same time are set, for example, by choosing the distance of the inner conductor of the resonator from the center conductor of the transmission line suitably.

In embodiments of the invention the number of discrete structural parts in the band stop filter is significantly smaller than in corresponding known filters, in which case the manufacture is cheaper and the reliability of the complete product is better. In addition, embodiments of the invention have the advantage that less intermodulation takes place in a filter according to it than in corresponding known filters. This is due to the fact that the number of metallic junctions is smaller because of the smaller number of structural parts. In addition, embodiments of the invention have the advantage that the tuning of the filter is relatively simple. Furthermore, other functional units, such as a low-pass filter or a directional coupler can be easily integrated into the structure of embodiments of the band stop filter.

Figure 3:
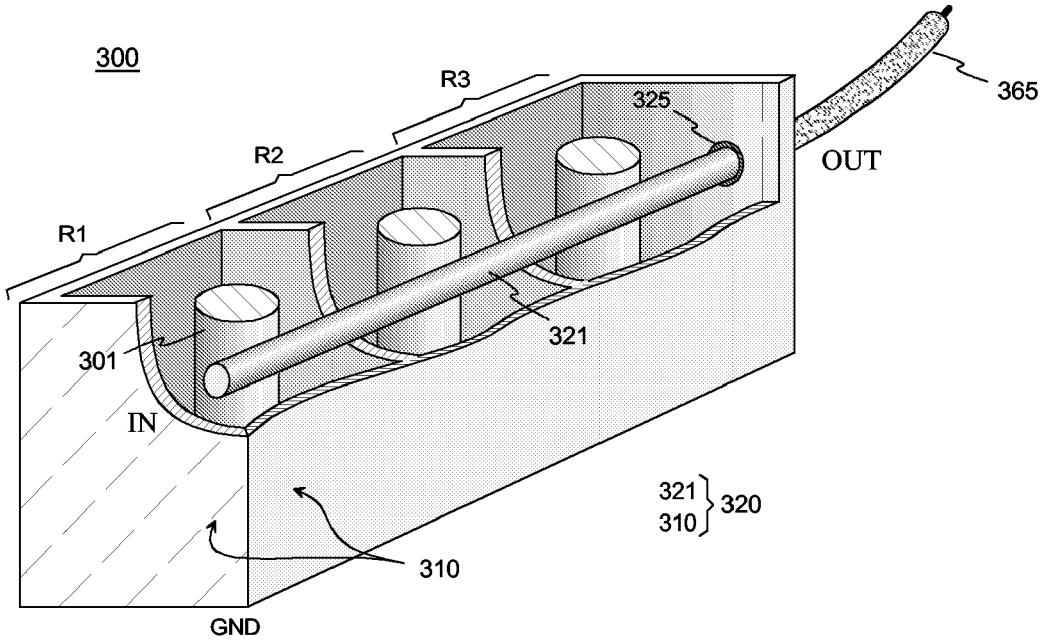
FIG. 3 shows an example of a band stop filter according to the invention.

FIG. 3 shows an example of a band stop filter according to the invention. The filter 300 comprises in a unitary conductive filter housing, a first R1, a second R2 and a third R3 coaxial resonator, like in FIG. 1. The filter housing 310, which comprises a bottom, side walls, end walls and a cover, has been drawn in FIG. 3 with its cover removed and cut open so that the inner conductors of the resonators, such as the inner conductor 301 of the first resonator, are partly visible. The inner space of the housing is divided by two conductive partition walls into resonator cavities. The lower ends of the resonator inner conductors join galvanically to the bottom of the housing and thus to the signal ground GND. Their upper ends have only a capacitive coupling to the cover of the housing and the surrounding, conductive walls, and so the resonators are quarter-wave resonators. In addition, the filter 300 comprises a transmission conductor 321. This is located inside the housing 310, running across the resonator cavities from the end wall of the housing to the opposite end wall through openings in them and in the partition walls. The transmission conductor is insulated from the end and partition walls by a dielectric medium, which can be air or some solid substance. In the former case, the transmission conductor rests on its galvanic end connections, and in the latter case, the medium forming a bushing-like piece supports the transmission conductor in place. FIG. 3 shows such an insulation bushing 325 on the end wall on the side of the third resonator R3.

The transmission conductor 321 and the housing 310 form a transmission line 320. The transmission conductor is thus the center conductor of the transmission line 320, the resonator housing functions as the outer conductor of the transmission line at the same time, and the cavity of the transmission line consists of the resonator cavities. The transmission line 320 continues from the side of the filter output port OUT as an ordinary coaxial cable 365. Its center conductor is connected by a coaxial connector at the end wall of the housing to the transmission conductor 321, and the sheath-like outer conductor to the end wall of the housing. A similar connector functioning as the input port IN of the filter is at the end wall of the housing on the side of the first resonator R1.

Following from the structure described above the field of the transmission line 320 and the field of a single resonator are in the same air space, in which case there is clearly an electromagnetic coupling between the transmission line and each resonator. In the example of FIG. 3, the transmission conductor 321 is beside the resonator inner conductors, close to the open upper end of the resonators, where there prevails an electric field while the resonator is oscillating. The coupling is therefore predominantly capacitive. The transmission conductor can as well be placed lower; the lower it is, the greater is the proportion of the magnetic field in the coupling. The principle of the function of the filter is the same as was explained in connection with FIG. 1. The transmission conductor itself corresponds to the coupling elements 141, 142, 143 of FIG. 1. The strengths of the couplings can be chosen by arranging the distances of the resonator inner conductors from the transmission conductor as suitable at the manufacturing stage. The natural frequencies of the resonators are arranged in a known manner to have slightly different values by varying primarily the electric length of the inner conductor. In that case each resonator causes an attenuation peak in the amplitude response curve at its natural frequency, and the response curve becomes like the one shown in FIG. 2.

Figure 4:
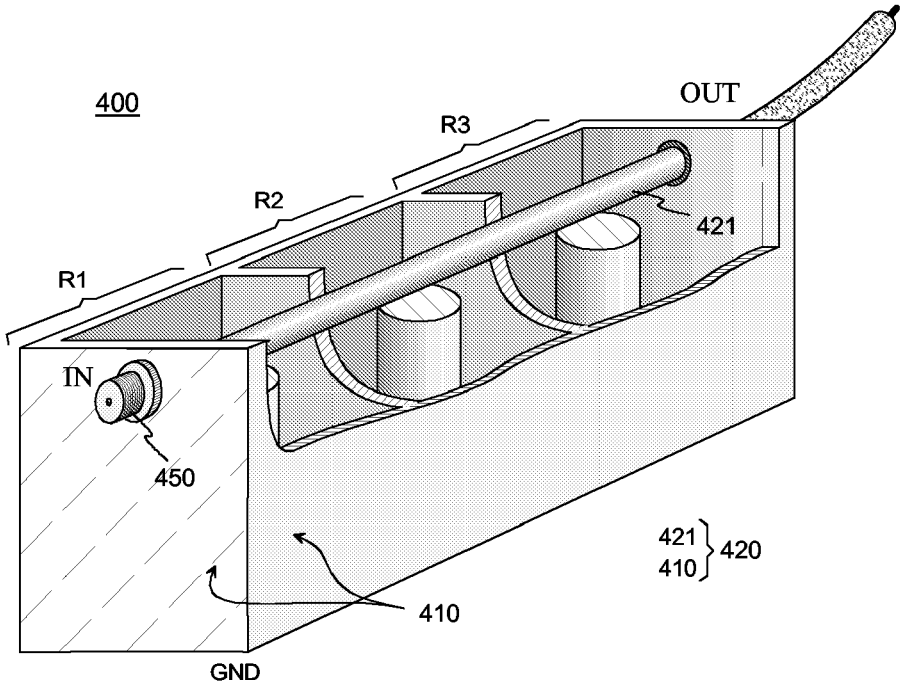
FIG. 4 shows a second example of a band stop filter according to the invention.

FIG. 4 shows a second example of a band stop filter according to the invention. The filter 400 is similar to the filter 300 of FIG. 3 with the difference that the transmission conductor 421, or the center conductor of the transmission line 420, is now above the inner conductors of the resonators, between the inner conductors and the cover of the housing. A coaxial connector 450 functioning as the input port IN of the filter at the end wall of the housing on the side of the first resonator R1 is also seen in the figure.

Figure 5:
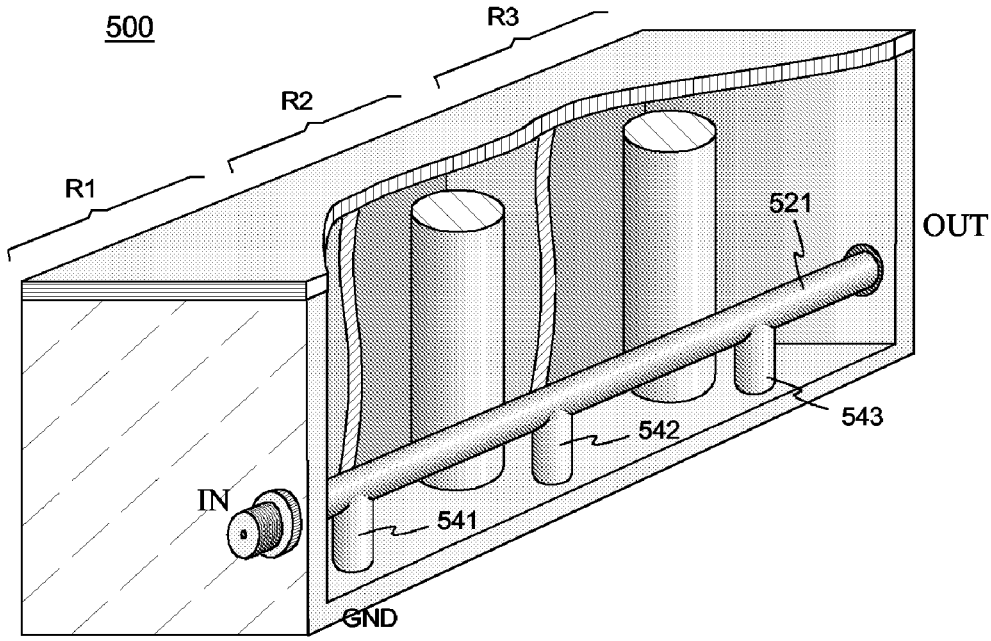
FIG. 5 shows a third example of a band stop filter according to the invention.

FIG. 5 shows a third example of a band stop filter according to the invention. The filter 500 differs from the filters shown in FIGS. 3 and 4 in that the transmission conductor 521 is now galvanically coupled to the bottom of the resonator housing. In the cavity of the first resonator R1, there is a coupling conductor 541 extending from the transmission conductor to the bottom of the housing, in the cavity of the second resonator R2 a second coupling conductor 542 extending from the transmission conductor to the bottom of the housing, and in the cavity of the third resonator R3 a third coupling conductor 543 extending from the transmission conductor to the bottom of the housing. The coupling conductors 541, 542 and 543 strengthen the inductive coupling between the transmission line and the resonators. The coupling conductors can be manufactured so that they are of the same piece with either the transmission conductor or the bottom of the housing, without junctions. The cover of the resonator housing is also seen as cut in FIG. 5.

Figure 1:
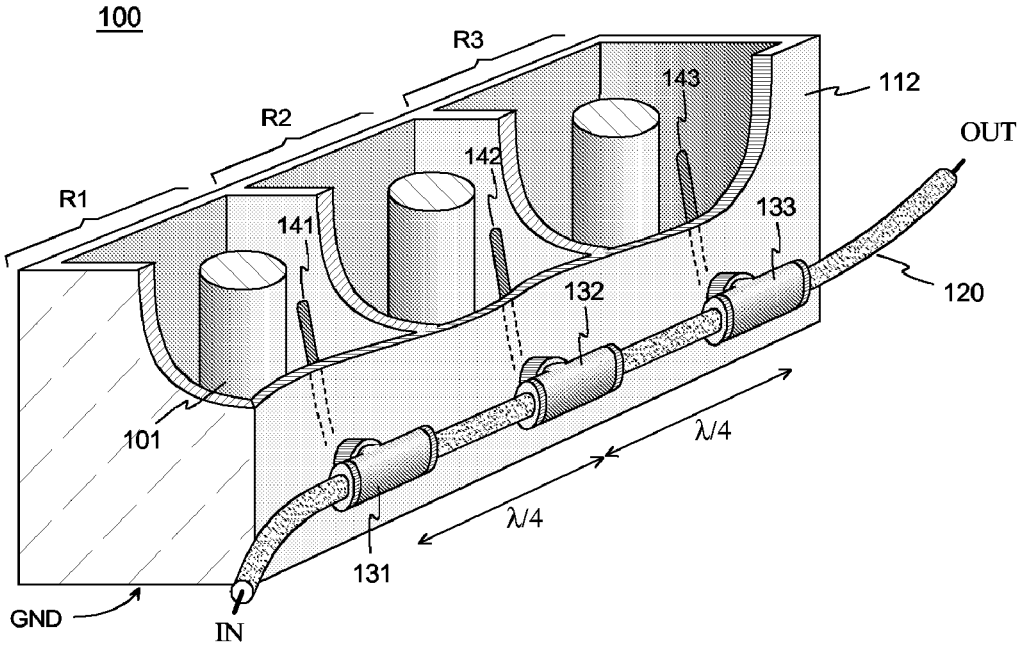
Fig. 1 PRIOR ART
FIG. 1 shows an example of a known band stop filter used as an antenna filter.
Figure 2:
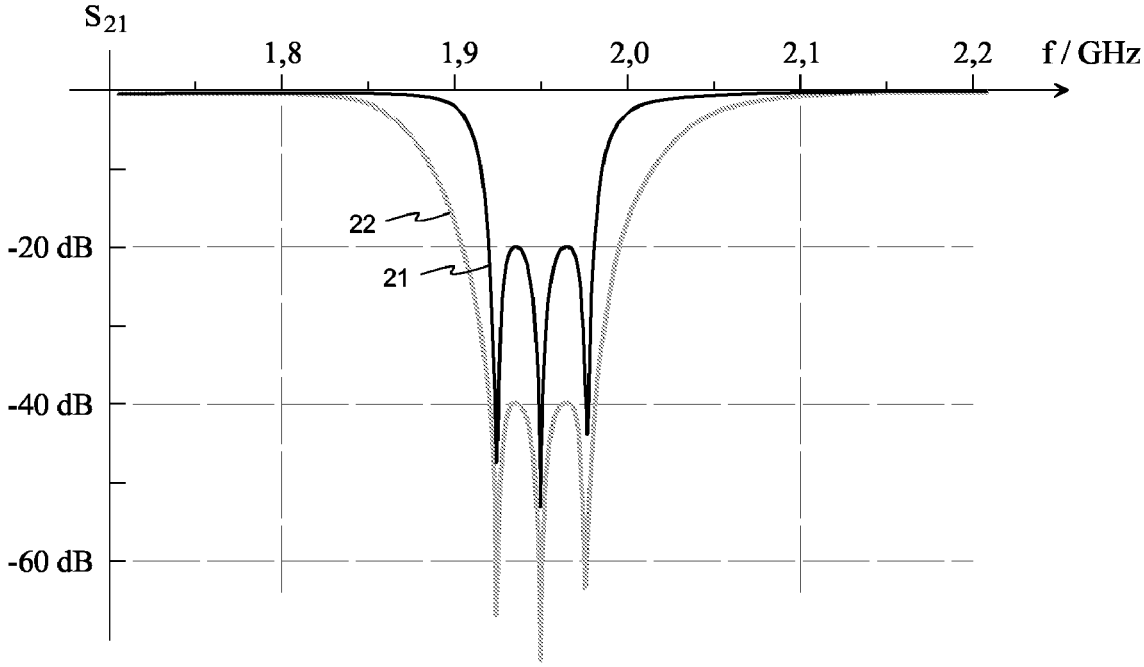
FIG. 2 shows examples of the amplitude response of three-resonator band stop filter.

By comparing the structures presented in FIGS. 2 to 5 to the one in FIG. 1, it becomes obvious how the invention provides a simplification of the structure. Similarly, it can be seen that the number of conductive junctions included in the structure is reduced to a small part of the original.

Figure 6:
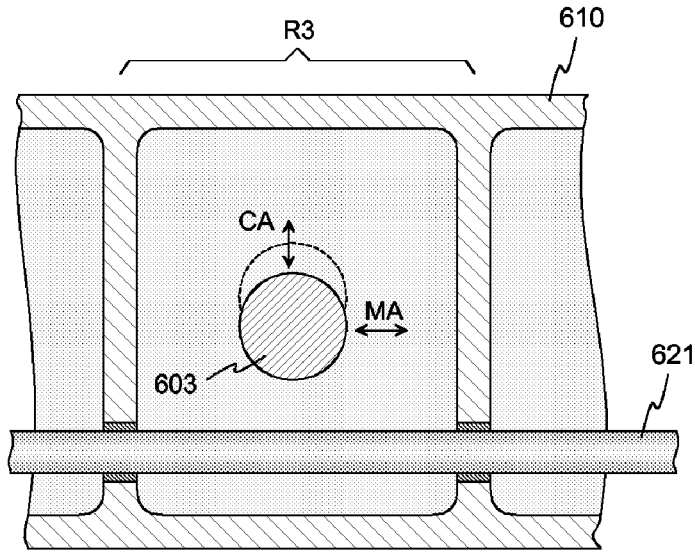
FIG. 6 presents the significance of the place of the inner conductor of a single resonator in a band stop filter according to the invention.

FIG. 6 indicates the significance of the place of the inner conductor of a single resonator in a band stop filter according to the invention. The figure presents a resonator R3 from above as horizontally cut open. The transmission conductor 621 belonging to the filter runs through the partition walls confining the resonator R3 and beside its inner conductor 603. As mentioned, the distance between the inner conductor and the transmission conductor has an effect on the strength of the coupling between the transmission line and the resonator. The coupling adjustment CA is thus implemented by choosing the place of the inner conductor in the perpendicular direction to the transmission conductor.

The impedance of a transmission line structure, which at the same time is a band stop filter, does naturally not remain exactly at its nominal value in the whole operating band of the device using the filter. The electric lengths of the portions of the transmission line between the resonators have an effect on the constancy of the impedance value. The electric length between two successive resonators changes if the distance between their inner conductors is changed, although the dimensions of the structure remain otherwise unchanged. The impedance matching adjustment MA can thus be implemented by choosing the place of the inner conductor 603 in the direction of the transmission conductor. In the optimum matching, the distances between the inner conductors of the successive resonators can vary slightly.

When the inner conductors are of the same piece with the resonator housing (without cover), their optimal places must be determined already before the housing is manufactured.

Figure 7:
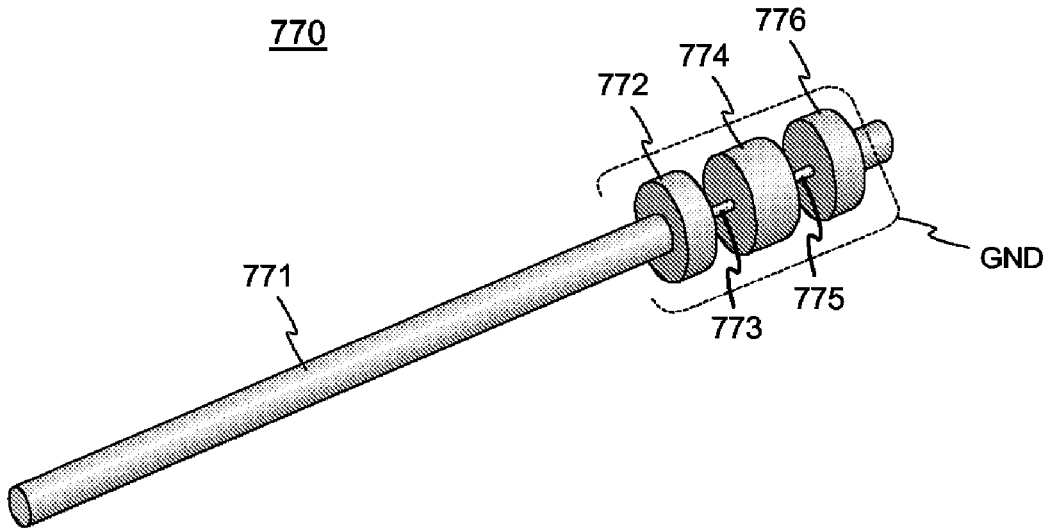
FIG. 7 shows an example of a transmission conductor, which enables an additional function in a structure according to the invention.

FIG. 7 presents an example of a transmission conductor, which enables an additional function in a structure according to the invention. Here the additional function is low-pass filtering. The transmission conductor 770 has a relatively long portion 771 of even thickness, which corresponds to the transmission conductors shown in FIGS. 3 to 6. In addition, the transmission conductor 770 has five cylindrical and relatively short extensions, the axes of which join the axis of the long portion 771. The diameters of the first 772, the third 774 and the fifth 776 extension in order are significantly greater than the diameter of the long portion. The diameters of the second 773 and the fourth 775 extension in order again are significantly smaller than the diameter of the long portion. The part of the transmission conductor formed by the extensions is placed in the filter housing in a cavity reserved for it outside the band stop filter, the walls confining that cavity functioning as the signal ground GND. The substantial characteristic of the first, third and fifth extensions is their capacitance with respect to the ground, and the substantial characteristic of the second and the fourth extensions is their inductance. These inductive portions are galvanically coupled in series through the thicker portions. The extensions together with the signal ground thus correspond to a low-passing LC chain made with discrete components, in which there are by turns a capacitor transversally and a coil in series. The values of the inductances and the capacitances naturally depend on the dimensioning of the portions, by which the response of the low-pass filter thus is determined.

An alternative way to integrate the low-pass filter into the structure according to the invention is to leave the thickness of the transmission conductor even for its whole length and make thickenings in the walls of the cavity of the low-pass filter, extending relatively close to the transmission conductor. The transverse capacitances are implemented by these.

It is also possible to integrate a directional coupler in the structure according to the invention by arranging a suitable electromagnetic coupling to the transmission conductor by some manner known as such. Further, if DC isolation is needed in the band stop filter, no discrete components are required for it. The end of the transmission conductor can be made hollow and continue the center conductor of the input or output line to the space created so that a sufficient capacitance is formed between the center conductor and the transmission conductor.

In this description and the claims, the qualifiers "lower" and "upper", as well as "from above" and "beside" refer to the position of the filter shown in FIGS. 3 to 5, and they have nothing to do with the position in which the filter is used.

Examples of the structure according to the invention have been described above. The invention is not limited to them only. For example, the number of resonators can vary, as well as the shape of the cross-section of the transmission conductor. The inventive idea can be applied in different ways within the scope set by the independent claim 1.

The invention claimed is:

1. A band stop filter, which comprises:

a transmission line with a center conductor and an outer conductor and a plurality of coaxial resonators;

the outer conductor forming a unitary conductive housing having an inner space which is divided by conductive partition walls into resonator cavities;

each of said resonator cavities containing at least one of the plurality of coaxial resonators, wherein each of the coaxial resonators separately has an electromagnetic coupling to the transmission line;

said coupling arranged by a coupling element to form an attenuation peak in a response curve of the filter, the natural frequencies of the coaxial resonators differing from each other to shape the response curve of the filter;

wherein the transmission conductor is located inside said housing, running through openings in said partition walls across all the resonator cavities; and wherein the housing is the outer conductor of the transmission line, and a portion of the transmission conductor in a resonator cavity is said coupling element.

2. The band stop filter according to claim 1, the transmission conductor running beside inner conductors of the coaxial resonators.

3. The band stop filter according to claim 1, the transmission conductor running above inner conductors of the coaxial resonators.

4. The band stop filter according to claim 1, the coupling element for each coaxial resonator including, in addition to a portion of the transmission conductor, a conductor, which connects it galvanically to a bottom of the housing.

5. The band stop filter according to claim 1, at least a distance between inner conductors of two successive coaxial resonators differing from another distance between inner conductors of two sequential coaxial resonators to match the impedance of transmitting path formed by the filter.

6. The band stop filter according to claim 1, the transmission conductor being a unitary rod-like piece.

7. The band stop filter according to claim 6, the distance between the inner conductor of at least a first coaxial resonator and the transmission conductor differing from the distance between the inner conductor of a second coaxial resonator and the transmission conductor to adjust the strength of the couplings and thus to shape the response curve of the filter.

8. The band stop filter according to claim 1, comprising an additional cavity in its housing for some additional function, and said transmission conductor also runs across the additional cavity.

9. The band stop filter according to claim 8, the transmission conductor having in the additional cavity relatively thick and thin portions by turns, in which case said additional function is low-pass filtering.

* * * * *